United States Patent [19]

McGraw

[11] Patent Number: 4,471,945

[45] Date of Patent: Sep. 18, 1984

[54] APPARATUS FOR HOISTING RAILCAR FREIGHT BRACING BULKHEADS AND TROLLEYS

[76] Inventor: Gary McGraw, Route 2, Minford, Ohio 45653

[21] Appl. No.: 537,690

[22] Filed: Sep. 30, 1983

[51] Int. Cl.[3] ..... B66D 1/38; B66D 3/00

[52] U.S. Cl. ..... 254/326; 254/327; 254/380

[58] Field of Search ..... 254/284, 288, 323, 325, 254/326, 327, 329, 380, 399; 410/129, 130, 131, 132, 133, 134, 135, 136, 137, 138, 139; 105/163 R; 212/205, 214, 219

[56] References Cited

U.S. PATENT DOCUMENTS

| | | | |
|---|---|---|---|
| 2,156,424 | 5/1939 | Barnard | 212/219 X |
| 2,437,486 | 3/1948 | Staiger | 212/205 X |
| 3,017,842 | 1/1962 | Nampa | 410/133 |
| 3,142,387 | 7/1964 | Minty | 212/214 |
| 3,572,513 | 3/1971 | Tantlinger et al. | 212/205 X |
| 4,019,442 | 4/1977 | Lee et al. | 410/136 X |

*Primary Examiner*—John M. Jillions
*Assistant Examiner*—Joseph J. Hail, III
*Attorney, Agent, or Firm*—George Wolken, Jr.

[57] ABSTRACT

An apparatus is described permitting rapid rehanging of fallen freight bracing bulkheads and trolleys, comprising a movable shaft mounted on the existing trolley tracks, a portable winch for raising detached bulkheads, and a ceiling jack, attachable to said movable shaft, causing the apparatus to be suitable for raising fallen bulkhead trolleys.

1 Claim, 7 Drawing Figures

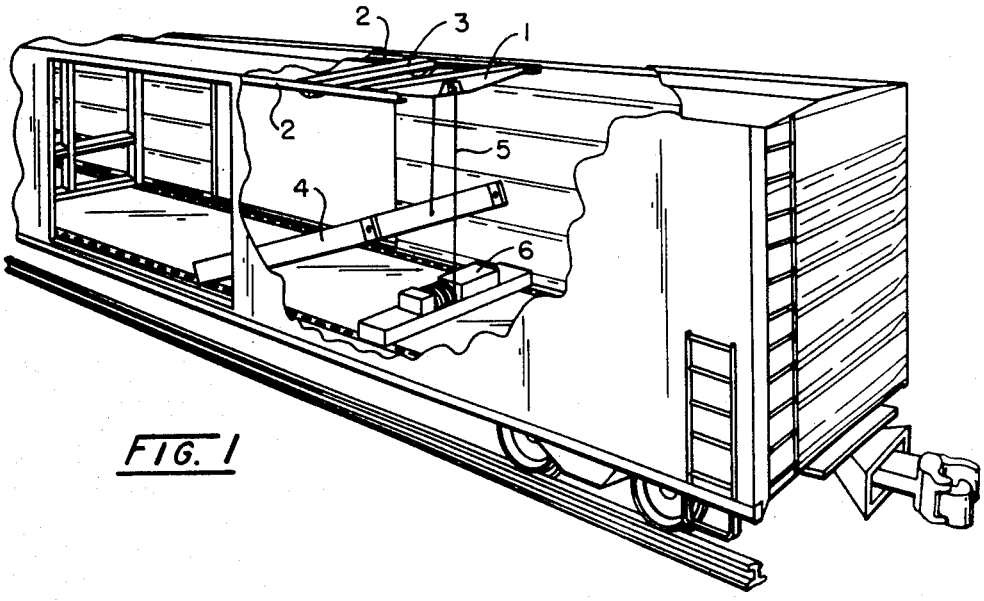
FIG. 1
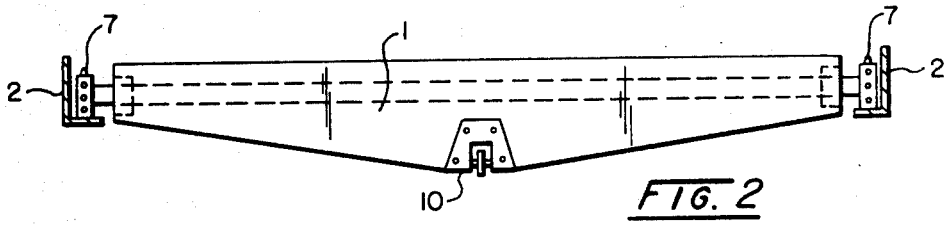
FIG. 2
FIG. 3
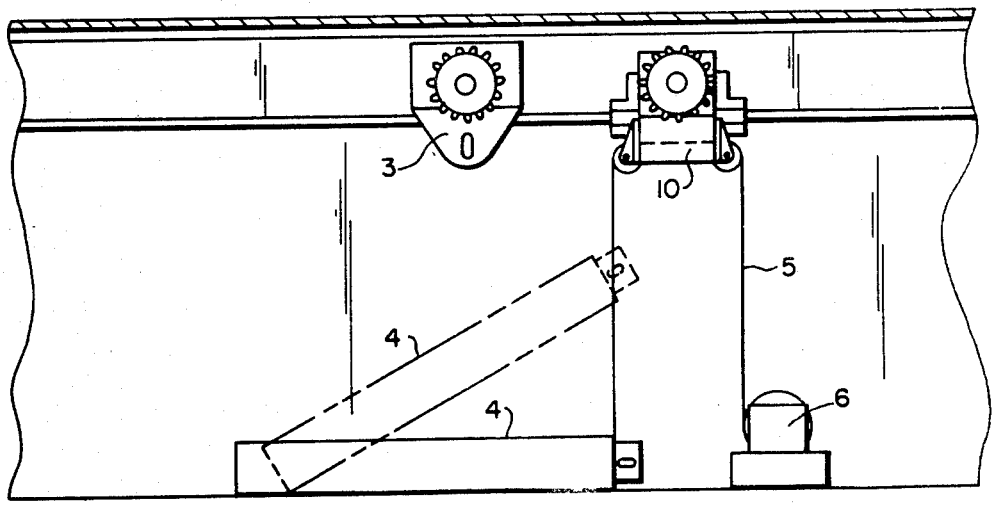

APPARATUS FOR HOISTING RAILCAR FREIGHT BRACING BULKHEADS AND TROLLEYS

BACKGROUND OF THE INVENTION

1. Technical Field

This invention relates to the technical area of movable freight bracing bulkheads for railcars. More particularly, this invention relates to an apparatus for easily and quickly hoisting and hanging said bulkheads after they have become disengaged during vigorous use of the railcar. In addition, this invention relates to an apparatus for easily and quickly hoisting and hanging the trolley whereon said bulkhead is mounted, as said trolley also may become disengaged during vigorous, normal use of said railcar.

2. Background Art

Bulkhead assemblies are commonly used to brace freight in railcars. Typically, freight will be loaded into a portion of a railcar. To conserve space, this freight will be typically stacked to the ceiling of said railcar and held firmly in place by means of a movable bulkhead. Said bulkhead typically is mounted on metal tracks running longitudinally along said railcar near the roof. A wheeled trolley is typically fitted to move longitudinally along said tracks, from which said bulkhead is suspended.

During normal use of a railcar, numerous impulses are typically encountered. Not infrequently, such impulses will cause the freight bracing bulkhead to become disengaged from said trolley. Also, for even more severe impulses, it occasionally may happen that the trolley also becomes disengaged from the tracks. This causes a substantial maintenance problem. Both trolley and bulkhead are massive, requiring the use of a mechanical hoist to reposition and rehang them in the proper positions within the railcar. In addition, the confined nature of the railcar interior requires the use of a suitable small and portable hoist mechanism. Finally, said hoisting device must permit the trolley and the freight bracing bulkhead to be held stably in position, permitting maintenance workers to reposition, rehang and firmly resecure said trolley and said bulkhead. Typically, when said bulkheads and trolley are disengaged, a hole is made in the roof of the railcar, permitting a cable to be lowered into the railcar for raising the fallen bulkhead and trolley. This requires fairly long maintenance periods, damage to the railcar, and introduces certain safety risks associated with securing the hoisting cable and its cargo securely in the correct position while workers secure the bulkhead and trolley.

The present invention describes a hoisting apparatus, easily installed on the existing longitudinal trolley tracks of freight cars, permitting rapid and safe rehanging of fallen bulkheads and trolleys.

A primary objective of this invention is to provide a means for permitting workers rapidly to rehang, reposition and resecure fallen freight bracing bulkheads and trolleys.

Another objective of this invention is to increase the safety of the workers engaged in said refitting of fallen freight bracing bulkhead and trolley assembles.

Yet another objective of this invention is to permit the rehanging of fallen bulkheads and trolleys without placing a hole in the roof of the railcar.

SUMMARY OF THE INVENTION

The present invention comprises an apparatus for raising and positioning railcar freight bracing bulkheads and trolleys after they have become detached during use of the railcar. The present invention comprises a movable shaft having toothed wheels at opposite ends thereof, of proper length to ride on the existing trolley tracks near the ceiling of a typical railcar. The present invention further comprises a pulley assembly attached near the center of said movable shaft, clamps for securing said movable shaft firmly in position, and a portable winch and cable for raising fallen bulkheads. The identical apparatus is also suitable for raising fallen bulkhead trolleys, with the addition of a detachable ceiling jack, described and claimed herein, permitting the trolley to be raised above the level of the trolley tracks whereon said movable shaft is positioned.

BRIEF DESCRIPTION OF DRAWINGS

FIG. 1. Cut away view of typical railcar with present invention in use to rehang a fallen freight bracing bulkhead.

FIG. 2. Longitudinal view of movable shaft.

FIG. 3. Transverse view of present invention, including movable shaft and winch, in use to rehang fallen bulkhead.

DESCRIPTION OF PREFERRED EMBODIMENTS

Figure 5:
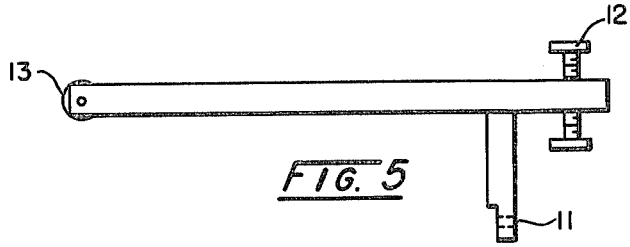
FIG. 5. Ceiling jack for use in remounting trolley in transverse view.
Figure 4:
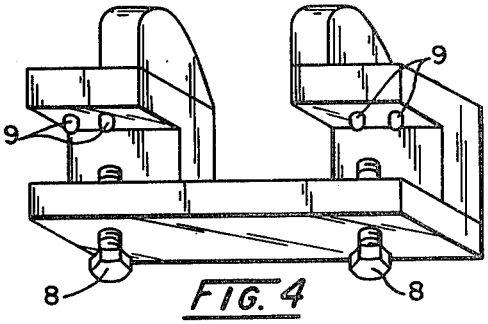
FIG. 4. Clamp for securing movable shaft in desired position.

Movable freight bracing bulkheads are commonly used to secure freight in railcars during transit. However, during normal usage on a typical railroad, the bulkhead and occasionally the trolley from which it is suspended, can become disengaged. Rehanging the detached bulkhead and trolley presents a considerable maintenance problem due to the weight of the bulkhead and trolley, and the confined space in a typical railcar. To avoid cutting a hole in the railcar ceiling, through which a cable from an external crane can be passed into the interior of the car, the present invention describes an apparatus for repositioning bulkheads and trolleys entirely within the railcar.

FIG. 1 shows schematically a typical embodiment of the present invention in operation. A movable shaft (1) is mounted on the trolley track (2) upon which the bulkhead trolley (3) moves. (FIG. 1 illustrates the case in which the trolley does not require remounting, or has already been remounted, and in which the bulkhead itself (4) remains to be rehung. Remounting the trolley by means of the present invention will be described below.) A cable (5) passes over a pulley assembly in shaft (2) attaching to the top center of the bulkhead (4). A winch (6) is used to raise the bulkhead, as shown in FIG. 1.

FIG. 2 shows in end view, longitudinally down the length of the railcar, the detailed assembly of the movable shaft (1). The shaft (1) extends the full width of the railcar and is terminated by toothed wheels (7). Said wheels (7) are designed to move along the perforated trolley track (2) in a manner similar to that of the bulkhead trolley itself (3). The movable shaft is positioned above the fallen object (bulkhead or trolley) and held firmly in position. Typically, two clamps as shown in FIG. (4) are employed to firmly secure the shaft (1), one clamp securing each wheel (7). Said clamp is positioned with wheel (7) in the opening between the two bolts (8), teeth (9) fitting into the holes in trolley track (2) at the appropriate position. Tightening bolts (8) secures said clamp to the trolley track, preventing the shaft (1) from moving.

FIG. (3) shows schematically in side view, transversely accross the railcar, the bulkhead (4) being raised by cable (5), and winch (6) for reattachment to trolley (3). The preferred embodiment of the pulley assembly (10) attahched to movable shaft (1) contains two pulleys as shown in FIG. (3). Even though a single pulley is adequate for rehanging the fallen bulkhead, a double pulley assembly is useful for rehanging the trolley while not materially affecting the performance of the present invention for hanging the bulkhead, as is obvious in FIG. 3.

Figure 6:
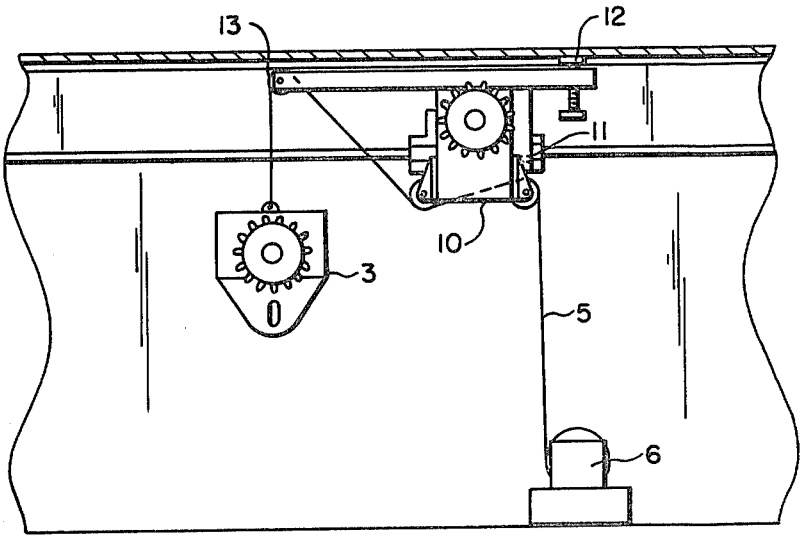
FIG. 6. Transverse view of present invention, including ceiling jack, in use to remount fallen trolley.

Remounting a fallen trolley is also accomplished by the present invention, employing an additional apparatus, a ceiling jack, shown in FIG. 5, and in use in FIG. 6. Said jack is firmly attached to the movable shaft, typically by bolting (11) to pulley assembly (10) through holes provided for the purpose. An adjustable foot (12) is located on one end of said ceiling jack which, when levered about the fulcrum (11), rests against the interior roof of the railcar and holds pulley (13) in position when it is loaded during rehanging of the freight bracing trolley (3).

FIG. 6 illustrates a trolley (3) in the process of being raised for remounting by cable (5) and winch (6). It is obvious from FIG. (6) the advantages of a double-pulley assembly (10) for hoisting trolleys. Said ceiling jack thus permits the fallen trolley to be raised above the level of the movable shaft for remounting on the trolley tracks.

Figure 7:
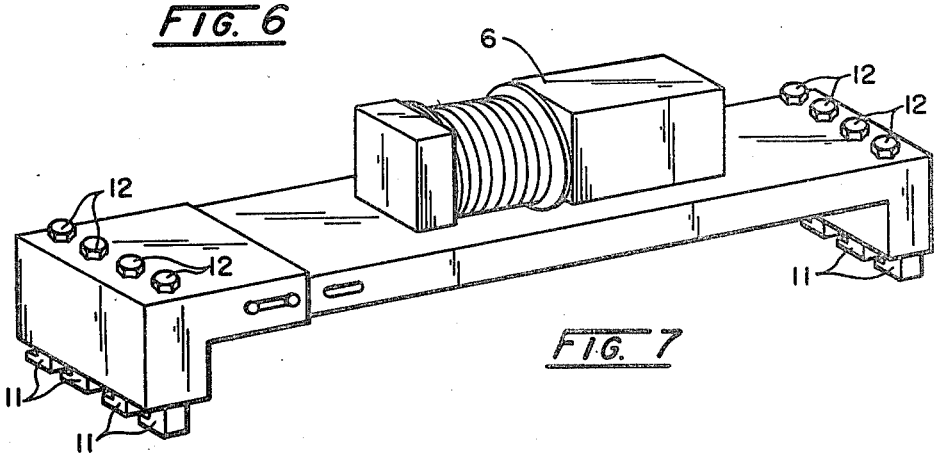
FIG. 7. Movable winch.

A portable winch is required to hoist both the freight bracing bulkhead (4) and trolley (3). A typical winch is shown in FIG. 7 having feet (11) rotatable from the position shown in FIG. 7 (permitting the winch to be removed from the floor of the railcar) to a position in which the feet (11) are aligned parallel to the center axis of the winch, at right angle to the position shown in FIG. 7. Rotation of bolts (12) accomplishes rotation of feet (11), permitting the winch to be secured into position, using tracks existing on the floor of typical freight carrying railcars, and safely locked into place.

What I claim is:

1. An apparatus for hoisting railcar freight bracing bulkhead trolleys comprising;

(a) a movable shaft extending transversely across a railcar near the roof thereof, the ends of said shaft resting upon longitudinally extending trolley tracks and positioned by means of toothed wheels attached to the ends of said shaft, said toothed wheels positioned by means of complimentary holes in said trolley tracks, (b) a pulley assembly comprising at least two pulleys attached to the underside of said movable shaft in approximately the center thereof, (c) a means for securing said movable shaft firmly in the desired position along said trolley tracks, (d) a ceiling jack, firmly attachable to said pulley assembly and extending longitudinally near the ceiling of said railcar, approximately perpendicular to said shaft, one end of said jack having a pulley, the opposite end of said jack having an adjustable support for maintaining counterforce against the ceiling of said railcar as said pulley and said jack are weighted, (e) a movable winch, firmly attachable to the floor of said railcar, capable of raising the detached bulkhead trolley by means of a cable passing through said pulley assembly on said movable shaft, passing over said pulley on said ceiling jack, and connecting to said bulkhead trolley.

* * * * *